US006672290B2

(12) United States Patent
Ricco

(10) Patent No.: US 6,672,290 B2
(45) Date of Patent: Jan. 6, 2004

(54) INTERNAL COMBUSTION ENGINE COMMON-RAIL INJECTION SYSTEM WITH A FUEL PREMETERING DEVICE

(75) Inventor: Mario Ricco, Casamassima (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 20 days.

(21) Appl. No.: 10/034,517

(22) Filed: Dec. 28, 2001

(65) Prior Publication Data

US 2002/0092503 A1 Jul. 18, 2002

(30) Foreign Application Priority Data

Dec. 29, 2000 (IT) ..... TO00A1227

(51) Int. Cl.[7] ..... F02M 37/04
(52) U.S. Cl. ..... 123/514; 123/506
(58) Field of Search ..... 123/506, 514, 123/510–11, 458, 497

(56) References Cited

U.S. PATENT DOCUMENTS

| | | | | |
|---|---|---|---|---|
| 4,838,232 A | * | 6/1989 | Wich | 123/506 |
| 5,560,549 A | | 10/1996 | Ricco et al. | 239/533.8 |
| 5,697,343 A | | 12/1997 | Isozumi et al. | 123/446 |
| 5,711,279 A | * | 1/1998 | Green et al. | 123/506 |
| 5,911,208 A | * | 6/1999 | Furusawa et al. | 123/506 |
| 6,024,064 A | | 2/2000 | Kato et al. | 123/179.17 |
| 6,131,829 A | * | 10/2000 | Ricco | 239/585.01 |
| 6,135,090 A | * | 10/2000 | Kawachi et al. | 123/446 |
| 6,192,856 B1 | * | 2/2001 | Shioi et al. | 123/300 |
| 6,192,864 B1 | * | 2/2001 | Nishimura | 123/458 |
| 6,343,588 B1 | | 2/2002 | Onishi et al. | 123/506 |
| 6,408,824 B1 | * | 6/2002 | Pacucci et al. | 123/467 |
| 6,510,843 B2 | * | 1/2003 | De Mathttaeis | 123/506 |
| 6,546,918 B2 | * | 4/2003 | Onishi et al. | 123/506 |

FOREIGN PATENT DOCUMENTS

| | | |
|---|---|---|
| DE | 19706099 | 8/1997 |
| DE | 19956267 | 5/2000 |
| DE | 19958249 | 11/2000 |
| EP | 0849438 | 6/1998 |
| EP | 0898074 | 2/1999 |

OTHER PUBLICATIONS

English abstract DE 19958249 dated Nov. 2, 2000.
English abstract of DE 19706099 Dated Aug. 21, 1997.
English abstract of DE 19956267 Dated May 31, 2000.

* cited by examiner

*Primary Examiner*—Thomas N. Moulis
(74) *Attorney, Agent, or Firm*—Ladas & Parry

(57) ABSTRACT

The fuel premetering device has a valve controlled by an electromagnet and located between a delivery conduit of a high-pressure pump supplying fuel to a common rail, and a drain conduit for draining surplus fuel. The valve is normally closed by a spring, and the electromagnet is energized to open the valve in opposition to the spring. The electromagnet is energized by a current varying in response to the operating conditions of the engine, and which is varied by a control unit from zero, at which the valve is closed completely by the spring, to a predetermined value, at which the electromagnet opens the valve completely, so that premetering is self-adaptive.

9 Claims, 3 Drawing Sheets

INTERNAL COMBUSTION ENGINE COMMON-RAIL INJECTION SYSTEM WITH A FUEL PREMETERING DEVICE

The present invention relates to an internal combustion engine common-rail injection system with a fuel premetering device.

BACKGROUND OF THE INVENTION

As is known, in modern internal combustion injection engines, each injector is supplied with high-pressure fuel by a common header or so-called "common rail", which is supplied by a high-pressure, normally piston, pump in turn supplied with fuel from the fuel tank by a low-pressure pump. The high-pressure pump supplies the common rail with fuel at a pressure controlled by a pressure regulating or fuel premetering device normally comprising a valve controlled by an electromagnet, i.e. a solenoid valve, which, when closed, supplies the common rail with all the fuel pumped by the high-pressure pump, and, when opened partly or fully, drains the fuel pumped in excess along a drain conduit back into the tank.

In known technology, the regulating device valve comprises a shutter, which is kept in the closed position by the armature of the electromagnet when this is energized, and which is kept in the open position by a spring when the electromagnet is deenergized. The electromagnet is energized by a current ranging between zero and a predetermined value to open the valve partly and regulate the pressure of the fuel supplied to the common rail.

The above method has various drawbacks. In particular, to keep the valve closed, the electromagnet must be supplied with the maximum excitation current, so that a high current must be varied to open the valve partly to regulate the fuel pressure. Moreover, if the electromagnet fails to be energized during operation of the engine, the valve is opened fully by the spring, thus draining the common rail completely and arresting the engine. Finally, when the electromagnet is energized by a low current to begin closing the valve, the friction-induced resistance to motion of the armature represents a far from negligible component part of total resistance, making fine fuel pressure adjustment difficult to achieve.

SUMMARY OF THE INVENTION

It is an object of the present invention to provide an internal combustion engine common-rail injection system with a fuel premetering device, which provides for a high degree of reliability, is cheap to produce, and eliminates the aforementioned drawbacks typically associated with known injection systems.

According to the present invention, there is provided a common-rail injection system for an internal combustion engine, having a fuel premetering device comprising a valve controlled by an electromagnet; said valve being located between a delivery conduit of a high-pressure pump supplying a common rail, and a drain conduit for draining surplus fuel; characterized in that said valve is normally closed by elastic means; said electromagnet being energized to open said valve in opposition to said elastic means.

More specifically, the electromagnet is energized by a current varying in response to the operating conditions of said engine, so that premetering is self-adaptive.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
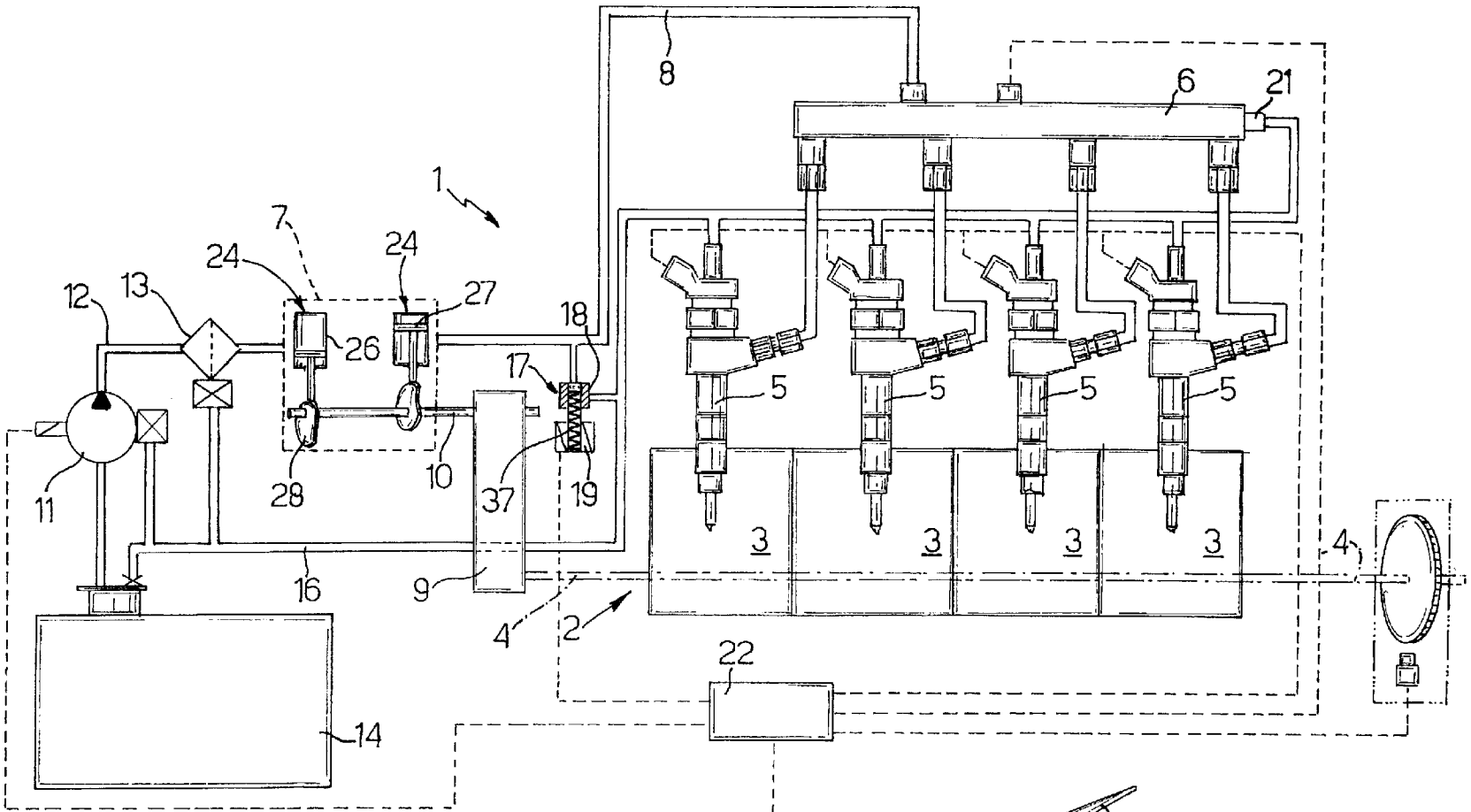
FIG. 1 shows a diagram of an internal combustion engine common-rail fuel injection system in accordance with the invention.

Number 1 in FIG. 1 indicates as a whole a common-rail fuel injection system of an internal combustion, e.g. diesel, engine 2 comprising a number of, e.g. four, cylinders 3 cooperating with corresponding pistons (not shown) activated to rotate a drive shaft 4 indicated by the dot-and-dash line in FIG. 1. Drive shaft 4 is connected by a transmission device 9 to a conventional camshaft 10 controlling the intake and exhaust valves of cylinders 3.

Injection system 1 comprises a number of electromagnetic injectors 5 associated with and for injecting high-pressure fuel into cylinders 3.

Injectors 5 are connected to a common header or so-called common rail 6, which is supplied with high-pressure fuel along a high-pressure delivery conduit 8 by a mechanical high-pressure pump 7.

High-pressure pump 7 is in turn supplied by a low-pressure, e.g. motor-driven, pump 11. A low-pressure delivery conduit 12 and a fuel filter 13 are located between motor-driven pump 11 and pump 7. And motor-driven pump 11 is normally housed in the fuel tank 14, in which a drain conduit 16 terminates to drain off the surplus fuel from motor-driven pump 11 and filter 13.

A pressure regulating device 17, for regulating the pressure in conduit 8, is located between delivery conduit 8 of high-pressure pump 7 and drain conduit 16, and comprises a solenoid valve defined by a valve 18 controlled by an electromagnet 19. Valve 18 provides for feeding any surplus fuel into drain conduit 16 to maintain the required pressure in common rail 6. Conduit 16 also feeds into tank 14 the drain fuel of injectors 5 and, via a pressure-limiting valve 21, any surplus fuel accumulated in common rail 6.

The fuel in tank 14 is at atmospheric pressure. In actual use, motor-driven pump 11 compresses the fuel to a low pressure, e.g. of about 2–3 bars; high-pressure pump 7 compresses the incoming fuel from conduit 12 to feed the fuel along conduit 8 to common rail 6 at a high pressure, e.g. of about 1500 bars; and each injector 5 injects into respective cylinder 3 a quantity of fuel ranging between a minimum and maximum value, under the control of an electronic control unit 22, which may be defined by the usual central microprocessor control unit controlling engine 2.

Control unit 22 receives signals indicating the operating conditions of engine 2—such as the position of accelerator pedal 23, the number of revolutions of drive shaft 4, and the fuel pressure in common rail 6, which are detected by corresponding sensors—and, by processing the incoming signals according to a given program, controls the instant and for how long individual injectors 5 are operated, as well as the flow of low-pressure motor-driven pump 11.

Figure 2:
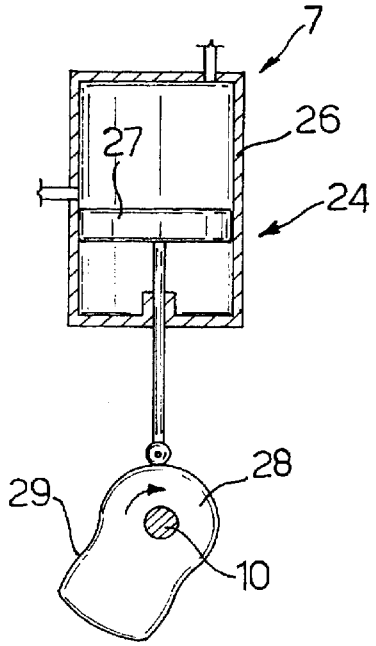
FIG. 2 shows a schematic section of a first variation of a high-pressure pump for the FIG. 1 injection system.

According to the invention, control unit 22 controls device 17 self-adaptively, so as to premeter the fuel supplied along conduit 8 to common rail 6. High-pressure pump 7 comprises one or more pumping elements 24, each having a cylinder 26 and a piston 27, which is activated by a corresponding cam 28, 30 (see FIGS. 2 and 3). Cams 28, 30 are carried by a drive shaft of pump 7, which is preferably defined by an engine shaft provided for other functions. For example, the drive shaft of pump 7 may be defined by shaft 10 operating the intake and exhaust valves of cylinders 3, or by drive shaft 4 itself.

Each pumping element 24 of pump 7 has a constant delivery at least equal to the maximum draw of each injector 5; and each cam 28, 30 is shaped to activate the corresponding pumping element 24 in synchronism, i.e. in pumping phase, with the corresponding injector 5, so as to minimize the variation in fuel pressure in common rail 6.

Since the fuel draw time of injectors 5 is variable, the synchronism or pumping phase of piston 27 and the corresponding injector 5 is intended in the sense that the stroke, controlled by cam 28, 30, of piston 27 is performed within the operating phase of the corresponding cylinder 3 of engine 2 when fuel is injected. Advantageously, the lifts of cam 28, 30 are designed to activate pumping element 24 with a phase of −50° to +20°(engine angle) with respect to the top dead center position at the compression stroke of the corresponding cylinder 3 of engine 2 when fuel is injected by the corresponding injector 5.

Device 17 premeters the fuel so that the amount of fuel supplied to conduit 8 by each pumping element 24 equals the sum of the amount of fuel to be injected by the corresponding injector 5, the amount of fuel required to operate injector 5, and any leakage, which varies according to the wear of injector 5. Any surplus fuel pumped by the activated pumping element 24 is drained by device 17 into conduit 16.

This therefore ensures that, following fuel injection into each cylinder 3 of engine 2, common rail 6 is supplied with substantially the amount of fuel drawn by the corresponding injector 5, so that, when fuel is next drawn, the fuel pressure has been restored. The volume of common rail 6 may therefore be minimized, so that injection system 1 is compact and cheap to produce, and can be designed for retrofitting, even on existing direct-injection engines, i.e. with no common rail 6.

In a first variation of pump 7 for injection system 1, each piston 27 of pump 7 is activated by a cam 28 (FIG. 2) having a lift 29 for performing a full stroke of piston 27. In which case, each pumping element 24 is activated each time in pumping phase with an injector 5 of engine 2 (FIG. 1). Pump 7 may have a number of pumping elements 24 equal to the number of injectors 5, in which case, cams 28 are timed on shaft 10 so that each pumping element 24 is activated in pumping phase with the corresponding injector 5.

Alternatively, pump 7 may have a number of pumping elements 24 equal to a submultiple of the number of injectors 5, or even only one pumping element 24. Transmission device 9 and/or the profile of cam 28 are therefore selected to activate each pumping element 24 in pumping phase with more than one injector 5 or even all of injectors 5.

In a further variation of high-pressure pump 7, each pumping element 24 is activated by a cam 30 (FIG. 3) with a segmented profile, so as to control the stroke of the corresponding piston 27 in two or more portions. Transmission device 9 and/or the profile of cam 30 are therefore selected so that each cam 30 moves piston 27 through a portion of its stroke in pumping phase with a corresponding injector 5.

Figure 3:
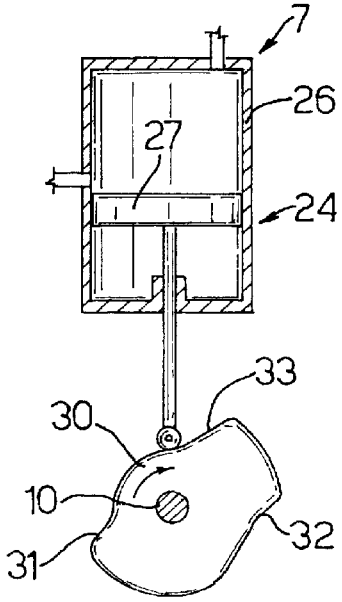
FIG. 3 shows a schematic section of a further variation of the high-pressure pump for the FIG. 1 injection system.

More specifically, for the engine 2 with four cylinders 3 in FIG. 1, the FIG. 3 pump 7 may have two pumping elements 24, and cam 30 of each piston 27 has a lift comprising two successive up or compression steps 31 and 32, and only one down or intake step 33. Each step 31 and 32 moves relative piston 27 through a corresponding portion of the compression stroke, while down step 33 controls a single intake stroke.

Figure 4:
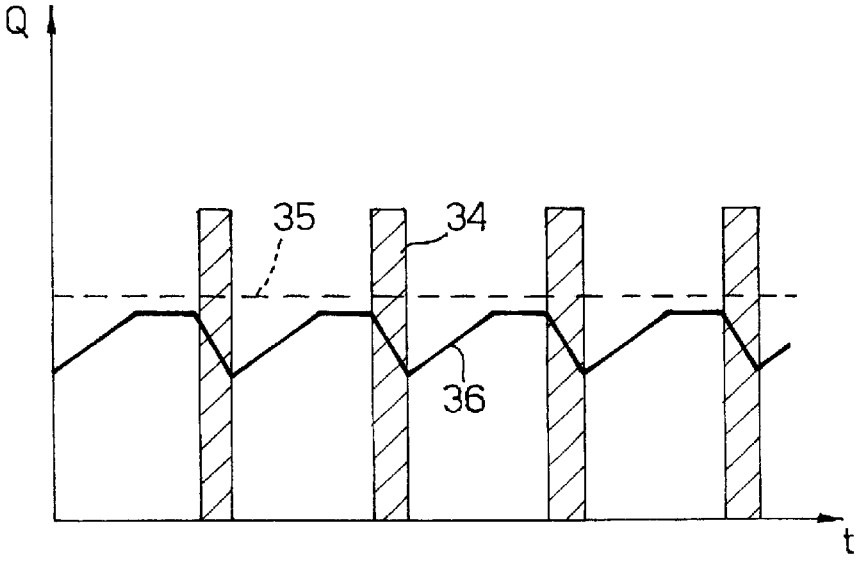
FIG. 4 shows an operating graph of the injection system according to the invention.

The bar graph 34 in FIG. 4 shows intermittent fuel draw from rail 6 made successively by injectors 5 of engine 2. The dash line 35 shows the maximum pressure, controlled by valve 21, of the fuel in rail 6, and the continuous line 36 the actual fuel pressure in rail 6. As shown clearly by line 36, by virtue of being pumped in phase by pumping elements 24 of pump 7, the fuel in rail 6 undergoes very little variation, which is limited to the interval between one draw and the next by injectors 5, and is therefore practically negligible.

Figure 5:
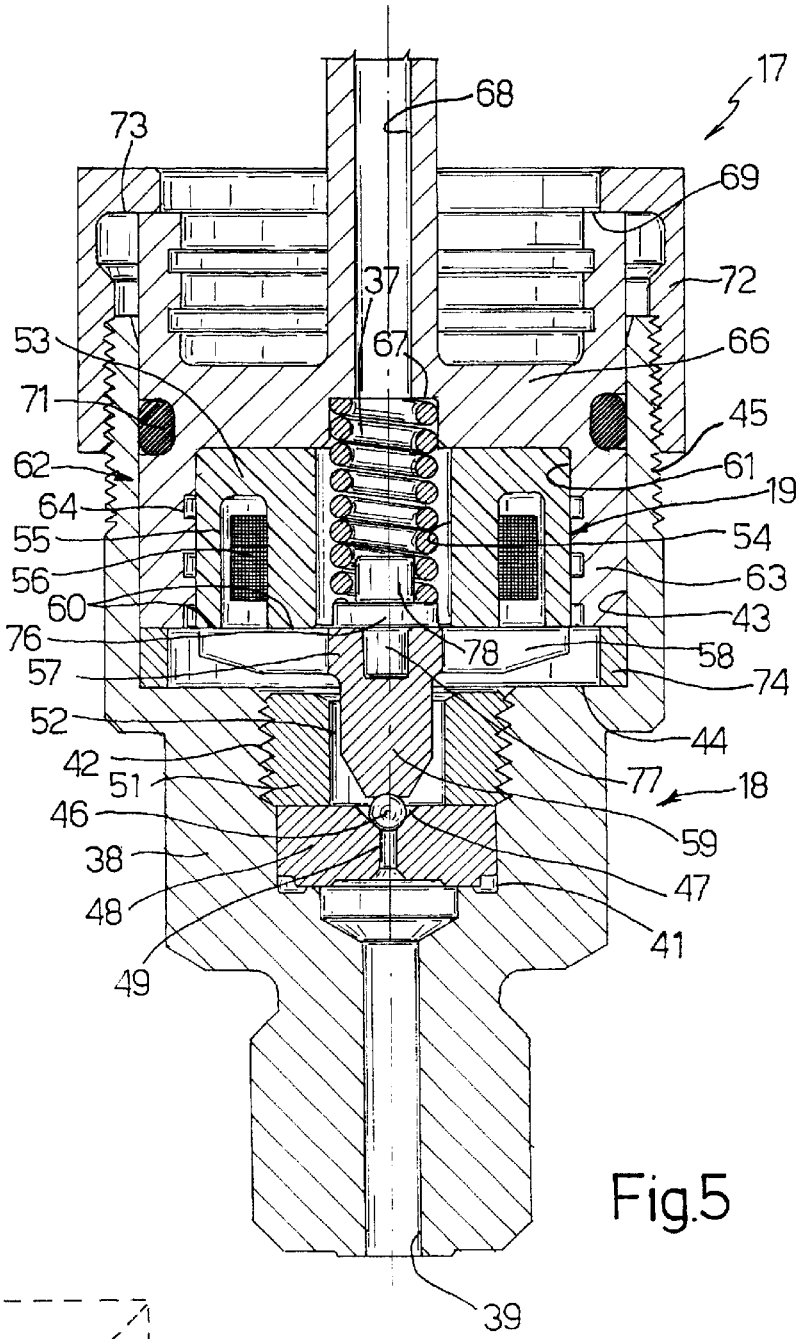
FIG. 5 shows a mid-section of a fuel premetering device for the FIG. 1 system.

Valve 18 of premetering device 17 is normally closed by elastic means, e.g. a spring 37 (FIG. 1), and electromagnet 19 is energized to open valve 18 in opposition to spring 37. In a preferred embodiment, valve 18 comprises a hollow, substantially cylindrical valve body 38 (FIG. 5) having an axial conduit 39 connectable, in use, to high-pressure conduit 8 (FIG. 1), and a first cylindrical cavity 41 communicating and coaxial with conduit 39. The lateral wall of cavity 41 has an internally threaded portion 42; valve body 38 also has a coaxial second cylindrical cavity 43 forming an annular shoulder 44 with cavity 41; and the lateral wall of cavity 43 has an externally threaded portion 45.

Valve 18 also comprises a shutter defined by a ball 46, which cooperates with a truncated-cone-shaped seat 47 of a cylindrical member 48 having a central hole 49. Member 48 is housed inside cavity 41, so that seat 47 communicates with axial conduit 39, and is fixed inside cavity 41 by a threaded inner ring nut 51 having a prismatic hole 52 engaged by an Allen wrench.

Electromagnet 19 comprises a cylindrical core 53 made of magnetic material and which has a central hole 54, and an annular cavity 55 housing the solenoid 56 of electromagnet 19. Solenoid 56 activates an armature 57 made of ferromagnetic material and in the form of a disk with radial slits 58. Armature 57 has an axial appendix or stem 59 housed in hole 52 and for engaging ball 46. The surface of armature 57 on the opposite side to stem 59 is flat and cooperates with two polar surfaces 60 of core 53.

Core 53 is forced inside a cylindrical cavity 61 of a cup-shaped body 62 comprising a lateral wall 63 with two annular grooves 64; an end wall 66 with an axial depression 67; an axial conduit 68 connected, in use, to drain conduit 16 of injection system 1; and an annular edge 69 on the opposite side to lateral wall 63.

Cup-shaped body 62 is housed inside cavity 41 of valve body 38 with the interposition of a high-pressure fuel seal 71, and is fixed inside cavity 41 of valve body 38 by a threaded outer ring nut 72 having a shoulder 73 engaging edge 69 of cup-shaped body 62. A calibrated shim 74 is interposed between shoulder 44 of valve body 38 and cup-shaped body 62, and defines the axial travel of armature 57.

Spring 37 of valve 18 is a helical compression spring, and is located between depression 67 in end wall 66 and a flange 76. Flange 76 has a pin 77 inserted inside an axial depression in armature 57; and a further pin 78 for guiding spring 37. Spring 37 is calibrated to keep ball 46 in the closed position until the fuel pressure in conduit 39 reaches the maximum operating value of injection system 1.

The component parts of valve 18 are assembled inside valve body 38 by first inserting cylindrical member 48 inside cavity 41. Inserting an Allen wrench inside hole 52, inner ring nut 51 is then screwed inside threaded portion 42 to fix member 48 firmly inside cavity 41 of valve body 38. On one side, ball 46 and stem 59 of armature 57 are then inserted inside hole 52 in member 48, and, on the other side, core 53 and solenoid 56 are inserted inside cup-shaped body 62.

Flange 76 and spring 37 are then inserted inside hole 54 in core 53; shim 74 is inserted inside cavity 41 of valve body 38; cup-shaped body 62 with seal 71 is inserted inside cavity 41; and outer ring nut 72 is screwed on to threaded portion 45, so that the edge of lateral wall 63 rests on shim 74, and cup-shaped body 62 is fixed firmly inside cavity 41 of valve body 38.

Self-adaptive premetering device 17 operates as follows.

Spring 37 normally keeps ball 46 in the closed position, so that none of the high-pressure fuel in conduit 39 passes through valve 18, and all the high-pressure fuel is fed along conduit 8 to common rail 6. When the pressure of the fuel in conduit 39 exceeds the set maximum, e.g. in the event of a fault on valve 21, the fuel pressure overcomes spring 37 to move ball 46 into the open position, so that the surplus fuel is drained into tank 14 via hole 49 in member 48, hole 52 in ring nut 51, slits 58 in armature 57, hole 54 in core 53, conduit 68 in cup-shaped body 62, and drain conduit 16.

When the operating conditions of engine 2 call for a lower fuel pressure than the maximum to which spring 37 is set, control unit 22 operates valve 18 to premeter fuel supply to rail 6 self-adaptively. That is, depending on the operating conditions of engine 2, unit 22 simultaneously emits a control signal for controlling the individual injector 5, and a control signal for controlling valve 18 and which energizes solenoid 56 of electromagnet 19 with a corresponding electric current I.

Electromagnet 19 therefore attracts armature 57 with a force in opposition to that of spring 37 to move ball 46 into a corresponding open position, so that the amount of fuel supplied to common rail 6 at each operation of a pumping element 24 substantially equals the amount of fuel drawn by the corresponding injector 5 at the same phase, and which equals the sum of the amount of fuel injected into cylinder 3, the amount of fuel used to operate injector 5, and the amount of fuel leaking through the joints of the various conduits of injector 5.

As is known, the most frequent variations in the flow of valve 18 are those close to the flow corresponding to the setting of spring 37, i.e. to the set maximum fuel pressure in rail 6, while variations in fuel flow at a fuel pressure close to drain pressure are more or less rare or useless. The excitation current of electromagnet 19 advantageously varies between zero, when ball 46 is to be kept in the closed position by spring 37, and a maximum value Imax, when valve 18 is to be opened fully. More specifically, electromagnet 19 is energized by a current I inversely proportional to the required pressure P in conduit 8, as shown by the continuous line in the FIG. 6 graph. Current I therefore varies between zero, to allow spring 37 to keep valve 18 fully closed so that the fuel pressure in conduit 8 is maximum, and a predetermined maximum value Imax to open valve 18 fully and reduce the fuel pressure to the atmospheric pressure in tank 14.

Figure 6:
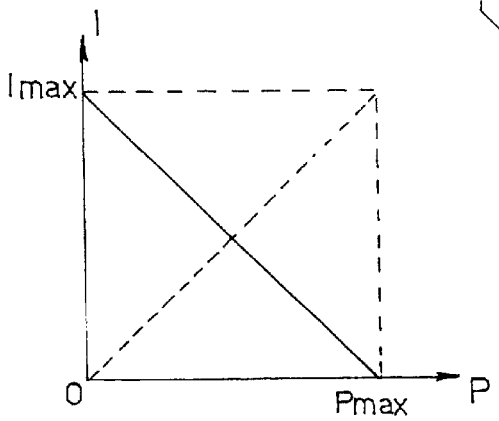
FIG. 6 shows an operating graph of the FIG. 5 premetering device.

The above control strategy of device 17 is the reverse of known pressure regulators, in which the regulating valve is closed when the electromagnet is energized, and in which the fuel pressure in conduit 8, in fact, is substantially inversely proportional to the excitation current I of the electromagnet, as shown by the dash line in FIG. 6. The reverse control strategy is particularly useful, since a small-volume rail 6 is subject to frequent microvariations in pressure, which can be corrected by energizing electromagnet 19 with a very low current.

The advantages, with respect to known injection systems, of the fuel injection systems according to the invention will be clear from the foregoing description. In particular, in the event electromagnet 19 fails to be energized, premetering device 17 ensures against any pressure drop in or fuel drainage from the common rail, so that the engine continues operating. Since variations in flow at pressures close to the setting of spring 37 are obtained with a very low current, operation of premetering device 17 is more reliable. And finally, since a low current is sufficient to control considerable forces generated by the high fuel pressure, and with respect to which the inertia and/or friction of ball 46 and armature 57 are negligible, the flow of valve 18 can be controlled extremely accurately.

Clearly, further changes can be made to the injection system as described herein without, however, departing from the scope of the accompanying claims. For example, valve 18 may also be used as a pressure regulator in known common-rail injection systems. And spring 37 in FIG. 5 may be replaced by a Belleville washer or leaf spring, and ball 46 by a plate.

What is claimed is:

1. A common-rail injection system for an internal combustion engine comprising:

a common rail (6);

a high-pressure pump (7) connected to said common rail (6) by a delivery conduit (8) to deliver fuel to said common rail (6); and a premetering device (17) connected to said delivery conduit (8) and to a drain conduit (16) which is connected to a fuel tank (14);

said premetering device comprising:

a valve (18) connected to said delivery conduit (8) and to said drain conduit (16) to control pressure of the fuel delivered to said common rail (6);

an elastic means (37) acting to close said valve (18); and an electromagnet (19) acting in opposition to said elastic means (37) to open said valve (18) and to control pressure of the fuel delivered to said common rail (6);

wherein said elastic means (37) is calibrated to close said valve (18) with a predetermined force such that when fuel pressure in said delivery conduit (8) exceeds said predetermined force of said elastic means (37), said valve (18) is opened and fuel can flow to said drain conduit (16); said valve normally being closed by said elastic means and said electromagnet de-energized.

2. An injection system as claimed in claim 1, wherein said electromagnet (19) is energized by a current (I) to open said valve (18) and obtain a corresponding fuel pressure (P) in the delivery conduit (8), said electromagnet being energized in response to operating conditions of said engine (2).

3. An injection system as claimed in claim 2 wherein said corresponding fuel pressure (P) is inversely proportional to said current (I);

said current (I) has a value between zero and a predetermined value Imax such that when said current (I) is zero, said valve (18) is closed by said predetermined force of said elastic means (37) and said corresponding fuel pressure (P) is at a maximum value and when said current (I) is Imax, said electromagnet (19) opens said valve (18) by a maximum amount such that said corresponding fuel pressure (P) is at a minimum value.

4. An injection system as claimed in claim 3, wherein said valve (18) comprises:

a shutter (46);

a seat (47) cooperating with said shutter (46) and communicating with said delivery conduit (8);

said elastic means (37) comprising a spring (37) acting on an armature (57) of said electromagnet (19).

5. An injection system as claimed in claim 4, wherein said armature (57) is in the form of a disk and cooperates with a cylinder core (53) acting on said shutter (46) by means of an axial appendix (59) of said disk.

6. An injection system as claimed in claim 5, wherein said spring (37) is a helical compression type and is housed in an axial hole (54) in said core (53); said drain conduit (16) communicating with said axial hole (54).

7. An injection system as claimed in claim 6, wherein said valve (18) comprises:

a valve body (38) having a first cylindrical cavity (41 );

said first cylindrical cavity (41) housing a member (48) having said seat (47);

said member (48) being fixed inside said first cylindrical cavity (41) by means of a threaded inner ring nut (51).

8. An injection system as claimed in claim 7, wherein said valve body (38) has a second cylindrical cavity (43) housing said electromagnet (19).

9. An injection system as claimed in claim 8, wherein said second cylindrical cavity (43) houses a cup-shaped body (62) inside said second cylindrical cavity (43) independently of said member (48).

* * * * *